US009980519B2

(12) United States Patent
Xiang

(10) Patent No.: US 9,980,519 B2
(45) Date of Patent: May 29, 2018

(54) ELECTRONIC CIGARETTE AND ATOMIZING METHOD THEREOF

(71) Applicant: HUIZHOU KIMREE TECHNOLOGY CO., LTD, Huizhou, Guangdong (CN)

(72) Inventor: Zhiyong Xiang, Guangdong (CN)

(73) Assignee: HUIZHOU KIMREE TECHNOLOGY CO., LTD. SHENZHEN BRANCH, Shenzhen, Guangdong (CN)

( * ) Notice: Subject to any disclaimer, the term of this patent is extended or adjusted under 35 U.S.C. 154(b) by 100 days.

(21) Appl. No.: 15/099,184

(22) Filed: Apr. 14, 2016

(65) Prior Publication Data

US 2016/0227840 A1 Aug. 11, 2016

Related U.S. Application Data

(63) Continuation of application No. PCT/CN2014/081359, filed on Jul. 1, 2014.

(51) Int. Cl.
*A24F 11/00* (2006.01)
*A24F 47/00* (2006.01)
(Continued)

(52) U.S. Cl.
CPC ..... *A24F 47/008* (2013.01); *H05B 1/0225* (2013.01); *H05B 1/0244* (2013.01); *H05B 3/0014* (2013.01)

(58) Field of Classification Search
CPC ..... H05B 1/0244; H05B 3/04; H05B 1/0225; H05B 3/0014; A24F 47/008; F24H 9/0005
(Continued)

(56) References Cited

U.S. PATENT DOCUMENTS

2010/0006113 A1 1/2010 Urtsev
2012/0048266 A1 3/2012 Alelov
(Continued)

FOREIGN PATENT DOCUMENTS

CN 101084801 A 12/2007
CN 101568269 A 10/2009
(Continued)

OTHER PUBLICATIONS

International Search Report for PCT/CN2004/081359, dated Apr. 15, 2015, ISA/CN.

*Primary Examiner* — Jean F Duverne
(74) *Attorney, Agent, or Firm* — U.S. Fairsky LLP; Yue (Robert) Xu

(57) ABSTRACT

An electronic cigarette includes an atomizer assemble which may be controlled by a button or airflow sensing. A button module and an airflow sensing module are integrated into the electronic cigarette. The user may directly smoke, and the airflow sensing module triggers the atomizer assemble to atomize tobacco tar to generate smoke. Alternatively, if the user wants to smoke, the user may press the button module. Because of the combination of the button module and the airflow sensing module, before the user puffs on the electronic cigarette, the user may press the button module, thus the atomizer assemble enters heating state and airflow channel is heated. In this way, when the user puffs on the electronic cigarette, the electronic cigarette may generate a lot of smoke.

11 Claims, 5 Drawing Sheets

(51) Int. Cl.
*H05B 1/02* (2006.01)
*H05B 3/00* (2006.01)

(58) Field of Classification Search
USPC ..... 131/328
See application file for complete search history.

(56) References Cited

U.S. PATENT DOCUMENTS

| | | | | |
|---|---|---|---|---|
| 2013/0255702 | A1 | 10/2013 | Griffith, Jr. et al. | |
| 2014/0270727 | A1* | 9/2014 | Ampolini | F24H 9/0005 392/387 |
| 2015/0173124 | A1* | 6/2015 | Qiu | A24F 47/008 131/328 |
| 2015/0313284 | A1* | 11/2015 | Liu | A24F 47/008 131/329 |
| 2016/0174611 | A1* | 6/2016 | Monsees | H05B 3/04 392/387 |

FOREIGN PATENT DOCUMENTS

| | | | |
|---|---|---|---|
| CN | 201393548 | Y | 2/2010 |
| CN | 202172847 | U | 3/2012 |
| CN | 102934843 | A | 2/2013 |
| CN | 103416852 | A | 12/2013 |
| CN | 203482902 | U | 3/2014 |
| WO | 2013020220 | A1 | 2/2013 |

* cited by examiner

ELECTRONIC CIGARETTE AND ATOMIZING METHOD THEREOF

CROSS-REFERENCE TO RELATED APPLICATION

This application is a continuation application of International Application PCT/CN2014/081359, titled "ELECTRONIC CIGARETTE AND ATOMIZING METHOD THEREOF", and filed on Jul. 1, 2014, which is incorporated herein by reference in its entirety.

FIELD

The disclosure relates to the field of electronic cigarettes, in particular to an electronic cigarette, of which an atomizer assemble may be controlled by a button or airflow sensing, and an atomizing method thereof.

BACKGROUND

For a conventional electronic cigarette, normally pressure change inside the electronic cigarette is sensed by an airflow sensor to activate an atomizer to atomize nicotine liquid so as to generate smoke, or a button of the electronic cigarette is pressed by the user to activate an atomizer to atomize nicotine liquid so as to generate smoke.

For the conventional electronic cigarette, the atomizer is started by only one of airflow and button to atomize nicotine liquid. For airflow startup, the electronic cigarette starts warming up only when airflow passes through the electronic cigarette, and gas in the airflow channel inside the electronic cigarette may directly enter oral cavity of a user when the user smoking, so that the oral cavity of the user feels uncomfortable due to entry of the low temperature gas. And when the user starts smoking, most of the airflow channel is occupied by air, therefore overall smoke volume is small and thin. Thereby, the electronic cigarette in the airflow startup mode can't achieve taste and smoke volume for puffing on the electronic cigarette which is achieved by pre-heating operation in the button startup mode. Thus effect and user experience of the imitation cigarette are poor. The electronic cigarette, the pre-heating operation of which is started by the button, is inconvenient for the user when two hands of the user are working such as operating a computer or driving a car, etc. The two starting modes both have flaws.

SUMMARY

In view of the foregoing issues, an electronic cigarette which can switch between a button and airflow sensing is provided. The electronic cigarette includes an electronic cigarette body.

The electronic cigarette body includes an airflow sensing module, an atomizer assembly, a button module, a battery assembly, a timing module and a microcontroller, where the microcontroller is configured to receive pulse signals from the airflow sensing module, the button module and the timing module and transmit a control signal to elements of the electronic cigarette body according to the pulse signals from the airflow sensing module, the button module and the timing module.

The airflow sensing module is electrically connected to the microcontroller, and is configured to detect pressure change inside the electronic cigarette body and transmit the pulse signal to the microcontroller.

The button module is electrically connected to the microcontroller, and is configured to transmit the pulse signal to the microcontroller according to pressing operation of a user to make the atomizer assembly performing preheating, causing more smoke volume to be generated when the user puffs on the electronic cigarette.

In a case that the user presses the button module a preset number of times during a preset time interval or the user presses and holds the button module during a period of time, the button module transmits the pulse signal to the microcontroller, and the microcontroller makes the electronic cigarette stop operation according to the pulse signal. In a case that the user presses the button module a preset number of times during a preset time interval or the user presses and holds the button module during a period of time, the button module transmits the pulse signal to the microcontroller, and the microcontroller makes the electronic cigarette return to normal operation according to the pulse signal.

The atomizer assembly is electrically connected to the microcontroller, and is configured to receive the control signal from the microcontroller to atomize nicotine liquid to generate smoke.

The timing module is electrically connected to the microcontroller, and is configured to start performing timing and make the atomizer assembly perform preheating under control of the microcontroller when the user presses the button module, and if the user does not puff on the electronic cigarette during a preset period of time, the timing module transmits the pulse signal to the microcontroller, and the microcontroller controls the atomizer assembly to stop preheating according to the pulse signal from the timing module to prevent overburning of the atomizer assembly.

The battery assembly is configured to supply electric energy to the microcontroller, the airflow sensing module, the atomizer assembly and other elements of the electronic cigarette.

Optionally, the airflow sensing module includes an airflow sensor or an integrated microphone switch.

Optionally, the atomizer assembly includes a heat-generating assemble.

The electronic cigarette body further includes a switch.

The switch is electrically connected to the microcontroller and the heat-generating assemble respectively, and the microcontroller controls to turn on the switch, causing the battery assembly to power the heat-generating assemble to atomize nicotine liquid to generate smoke.

Optionally, the electronic cigarette body further includes a battery protective module.

The battery protective module includes a charge protective unit and a power protective unit.

The charge protective unit is configured to detect charging voltage and charging current of the battery assembly, and break the charging circuit off in a case that the charging voltage or/and charge current is excessive.

The power protective unit is configured to break a power circuit off in a case that voltage and/or current in the power circuit is excessive, when the battery assemble powers the elements of the electronic cigarette body.

Optionally, the power protective unit includes two field effect transistor with drains electrically connected to each other.

Optionally, the electronic cigarette body further includes a display device.

The display device is electrically connected to the microcontroller, and is configured to display operational state of the electronic cigarette.

Optionally, the electronic cigarette body further includes a boost module.

The boost module is electrically connected to the microcontroller, the battery assembly and the atomizer assembly respectively, and is configured to raise voltage supplied to the atomizer assembly from the battery assembly, causing the atomizer assembly to quickly heat nicotine liquid to generate smoke.

Optionally, the electronic cigarette body further includes a voltage stabilizing module.

The voltage stabilizing module is electrically connected to the microcontroller and the battery assembly respectively, and is configured to enable the battery assembly to supply stable voltage for the microcontroller.

Optionally, the voltage stabilizing module includes a diode and a voltage regulator.

The diode is connected to the voltage regulator in series.

The anode of the diode is electrically connected to a power port of the battery assemble, the cathode of the diode is electrically connected to an input port of the voltage regulator, and the diode is configured to prevent reverse conduction of current.

An atomizing method of an electronic cigarette includes:

pressing a button module, and transmitting, by the button module, a first pulse signal to a microcontroller;

controlling, by the microcontroller, an atomizer assembly to atomize tobacco tar to generate smoke according to the first pulse signal from the button module;

when a user puffs on the electronic cigarette, sensing, by an airflow sensing module, pressure change inside the electronic cigarette body, and transmitting a second pulse signal to the microcontroller; and controlling, by the microcontroller, the atomizer assembly to continually atomize tobacco tar to generate smoke according to the second pulse signal from the airflow sensing module.

Optionally, the microcontroller controls a timing module to start timing according to the first pulse signal from the button module;

in a case that the user does not puff on the electronic cigarette during a preset period of time, the timing module transmits a fourth pulse signal to the microcontroller; and the microcontroller controls the atomizer assembly to stop atomizing according to the fourth pulse signal.

Optionally, when the user puffs on the electronic cigarette again, the airflow sensing module senses pressure change inside the electronic cigarette body, and transmits the second pulse signal to the microcontroller.

The microcontroller controls the atomizer assembly to continually atomize tobacco tar to generate smoke according to the second pulse signal from the airflow sensing module.

Optionally the user presses the button module a preset number of times during a preset time interval, and in a case that the number of times for pressing the button is equal to or greater than the preset number of times, the microcontroller controls the electronic cigarette to stop operation; and the user presses the button module a preset number of times during a preset time interval, and in a case that the number of times for pressing the button is equal to or greater than the preset number of times, the microcontroller controls the electronic cigarette to return to normal operation.

Optionally, in a case that the user presses and holds the button module during a preset period of time, the microcontroller controls the electronic cigarette to stop operation; and in a case that the user presses and holds the button module during a preset period of time, the microcontroller controls the electronic cigarette to return to operation.

It is can be seen from foregoing technical solutions that the disclosure has following advantages.

According to the disclosure, a button module and an airflow sensing module are integrated into an electronic cigarette. The user may directly smoke, and the airflow sensing module triggers the atomizer assembly to atomize nicotine liquid to generate smoke. Alternatively, if the user wants to smoke, the user may press the button module to trigger the atomizer assembly to atomize nicotine liquid to generate smoke, thereby bringing use convenience to the user. For example, the user may directly smoke without pressing the button module when driving, and the user may smoke by pressing the button module in other situations.

Because of the combination of the button module and the airflow sensing module, before the user puffs on the electronic cigarette, the user may press the button module, thus the atomizer assembly warms up, and the airflow channel is heated. In this way, when the user puffs on the electronic cigarette, a lot of smoke may be generated. If the user puffs on a conventional electronic cigarette which is not used for a long time, at low environmental temperature, since most of the airflow channel is occupied by cold air, the user breathes a lot of cold air and overall smoke volume is small and thin, thereby causing uncomfortable feelings for oral cavity of the user. Meanwhile the conventional electronic cigarette can't achieve taste and volume required by smoking, causing poor effect and user experience of the imitation cigarette. This problem of the conventional electronic cigarette can be avoided by the electronic cigarette of the disclosure.

After the user presses the button module so that the atomizer assembly performs preheating, the user starts to smoke. Thus, the user does not need suction as much as an electronic cigarette with only an airflow sensing module, so that the user does not need too much suction quantity. Since once the button module is pressed, the atomizer assembly performs preheating and starts atomizing nicotine liquid to generate smoke. When the user smokes, the atomizer assembly may generate a lot of smoke with only slight suction of the user, thereby bringing good smoking effect, and bringing good smoking experience to the user.

If the user does not puffs on the electronic cigarette during a preset period of time, the microcontroller controls the atomizer assembly to stop preheating according to a pulse signal from the timing module of the electronic cigarette body to prevent overburning of the atomizer assembly, thereby effectively preventing damage of the electronic cigarette.

According to some embodiments of the invention, in a case that the user presses the button module a preset number of times during a preset time interval or the user presses and holds the button module during a period of time, the button module may transmit a pulse signal to the microcontroller. The microcontroller makes the electronic cigarette stop operation. According to some embodiments of the invention, in a case that the user presses the button module a preset number of times during a preset time interval or the user presses and holds the button module during a period of time, the button module may transmit a pulse signal to the microcontroller. The microcontroller makes the electronic cigarette return to normal operation according to the pulse signal. In this case, the electronic cigarette may be controlled by operating the button module. When the user does not smoke, the electronic cigarette is shut down to prevent malfunction of the electronic cigarette. It can also avoid that the button module is accidentally touched by the user who is carrying the button module, which may cause operation of the electronic cigarette and damage of the electronic cigarette.

BRIEF DESCRIPTION OF THE DRAWINGS

To describe the technical solutions for the embodiment of the present disclosure or technical solution in conventional technology more clearly, the following briefly describes the drawings involved in the embodiments of the present disclosure or in the conventional technology. Apparently, the drawings described below are some embodiments, and persons of ordinary skill in the art can derive other drawings according to the drawings without any creative effort.

DESCRIPTION OF DRAWING SIGNS

Figure 1:
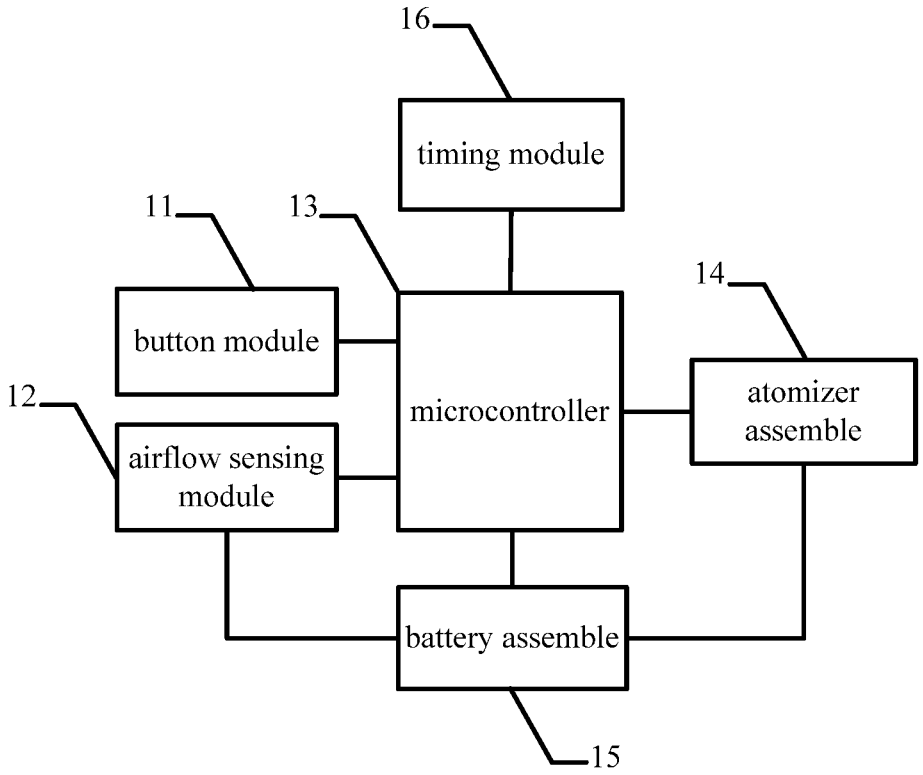
FIG. 1 is an overall schematic diagram of an electronic cigarette provided according to the disclosure.

11 button module
12 airflow sensing module
13 microcontroller
14 atomizer assembly
15 battery assembly
16 timing module
21 switch
22 charge protective unit
23 power protective unit
24 display device
31 electric heating wire
32 button switch
33 airflow sensor
41 voltage regulator
42 diode

DETAILED DESCRIPTION OF THE EMBODIMENTS

An electronic cigarette which can switch between the button and airflow sensing is provided according to the disclosure. Referring to FIG. 1, the electronic cigarette includes an electronic cigarette body, which is provided with an airflow sensing module 12, an atomizer assembly 14, a button module 11, a battery assembly 15, a timing module 16 and a microcontroller 13. The microcontroller 13 is configured to receive pulse signals from the airflow sensing module 12, the button module 11 and the timing module 16, and transmit control signals to elements of the electronic cigarette body according to the pulse signals from the airflow sensing module 12, the button module 11 and the timing module 16.

The airflow sensing module 12 is electrically connected to the microcontroller 13, and is configured to transmit a pulse signal to the microcontroller 13 according to sensed pressure change inside the electronic cigarette body. The button module 11 is electrically connected to the microcontroller 13, and is configured to transmit a pulse signal to the microcontroller 13 to make the atomizer assemble 14 perform preheating according to pressing operation of the user. Thus, when the user puffs on the electronic cigarette, more smoke volume may be generated.

According to some embodiments of the invention, in a case that the user presses the button module 11 a preset number of times during a preset time interval or the user presses and holds the button module 11 during a period of time, the button module 11 may transmit a pulse signal to the microcontroller 13. The microcontroller 13 makes the electronic cigarette stop operation according to the pulse signal. According to some embodiments of the invention, in a case that the user presses the button module 11 a preset number of times during a preset time interval or the user presses and holds the button module 11 during a period of time, the button module 11 may transmit a pulse signal to the microcontroller 13. The microcontroller 13 makes the electronic cigarette return to normal operation according to the pulse signal.

The atomizer assembly 14 is electrically connected to the microcontroller 13, and is configured to receive a control signal from the microcontroller 13 so as to atomize nicotine liquid to generate smoke.

The timing module 16 is electrically connected to the microcontroller 13. When the user presses the button module 11 to make the atomizer assembly 14 perform preheating under control of the microcontroller 13, the timing module 16 start timing. If the user does not puff on the electronic cigarette during a preset period of time, the timing module 16 transmits a pulse signal to the microcontroller 13. The microcontroller 13 controls the atomizer assembly 14 to stop preheating according to the pulse signal from the timing module 16 to prevent overburning of the atomizer assembly 14.

The battery assembly 15 is configured to supply electric energy to the microcontroller 13, the airflow sensing module 12, the atomizer assembly 14 and other elements of the electronic cigarette.

Specifically, the electronic cigarette includes both the button module 11 and the airflow sensing module 12. When the user smokes, the airflow sensing module 12 triggers the atomizer assembly 14 to atomize nicotine liquid to generate smoke. Alternatively, the user may press the button module 11 to trigger the atomizer assembly 14 to atomize nicotine liquid to generate smoke. Thereby it is convenient to the user. For example, the user may smoke without pressing the button module when driving, and the user may smoke by pressing the button module 11 in other situations.

Because of the combination of the button module 11 and the airflow sensing module 12, before the user puffs on the electronic cigarette, the user may press the button module 11, thus the atomizer assembly 14 warms up, and the airflow channel is heated. In this way, when the user puffs on the electronic cigarette, a lot of smoke may be generated. If the user puffs on a conventional electronic cigarette which is not used for a long time, at low environmental temperature, since most of the airflow channel is occupied by cold air, the user breathes a lot of cold air and overall smoke volume is small and thin, thereby causing uncomfortable feelings for oral cavity of the user. Meanwhile the conventional electronic cigarette can't achieve taste and volume required by smoking, causing poor effect and poor user experience of the imitation cigarette. This problem of the conventional electronic cigarette can be avoided by the electronic cigarette of the disclosure including both the button module 11 and the airflow sensing module 12. After the user presses the button module 11 so that the atomizer assembly 14 performs preheating, the user starts to smoke. Thus, the user does not need suction as much as an electronic cigarette with only an airflow sensing module, so that the user does not need too much suction quantity. Since once the button module 11 is pressed, the atomizer assembly 14 performs preheating and starts atomizing nicotine liquid to generate smoke. When the user smokes, the atomizer assembly may generate a lot of smoke with only slight suction of the user, thereby bringing good smoking effect, and bringing good smoking experience to the user.

If the user does not puff on the electronic cigarette during a preset period of time, the microcontroller 13 controls the atomizer assembly 14 to stop preheating according to the pulse signal from the timing module 16 of the electronic cigarette body, thereby preventing overburning of the atomizer assembly 14, and effectively prevent damage of the electronic cigarette.

The timing module 16 may be integrated into the microcontroller 13, so that the microcontroller may not only control the elements of the electronic cigarette, but also have a timing function, i.e., the timing module 16 and the microcontroller 13 may be implemented by using single chip microcomputer, etc, which is not limited herein.

According to some embodiments of the invention, in a case that the user presses the button module 11 a preset number of times during a preset time interval or the user presses and holds the button module 11 during a period of time, the button module 11 may transmit a pulse signal to the microcontroller 13. The microcontroller 13 makes the electronic cigarette stop operation. According to some embodiments of the invention, in a case that the user presses the button module 11 a preset number of times during a preset time interval or the user presses and holds the button module 11 during a period of time, the button module 11 may transmit a pulse signal to the microcontroller 13. The microcontroller 13 makes the electronic cigarette return to normal operation according to the pulse signal. In this case, the electronic cigarette may be controlled by operating the button module 11. When the user does not smoke, the electronic cigarette is shut down to prevent malfunction of the electronic cigarette. It can also avoid that the button module is accidentally touched by the user who is carrying the button module, which may cause operation of the electronic cigarette and damage of the electronic cigarette.

According to the disclosure, the airflow sensing module 12 may be an airflow sensor or an integrated microphone switch, and type of the airflow sensing module 12 is not limited herein.

According to the disclosure, the user presses the button module 11 a preset number of times during a preset time interval or the user presses and holds the button module 11 during a preset period of time, the number of times for pressing the button or the period of time for holding the button may be set during fabricating the electronic cigarette, specifically, the number of times may be two or three, etc, the period of time may be 3 seconds or 5 seconds, etc, and the number of times and the period of time are not limited herein.

To make the purpose, features and merits of the disclosure more obvious and understandable, the technical solutions are clearly and completely described in the following in conjunction with drawings according to the embodiments of the disclosure. Apparently, the described embodiments are merely a few rather than all of the embodiments of the present disclosure. All other embodiments obtained by persons of ordinary skill in the art are based on the embodiments of the present disclosure without creative efforts shall fall within the protection scope of the present disclosure.

Figure 2:
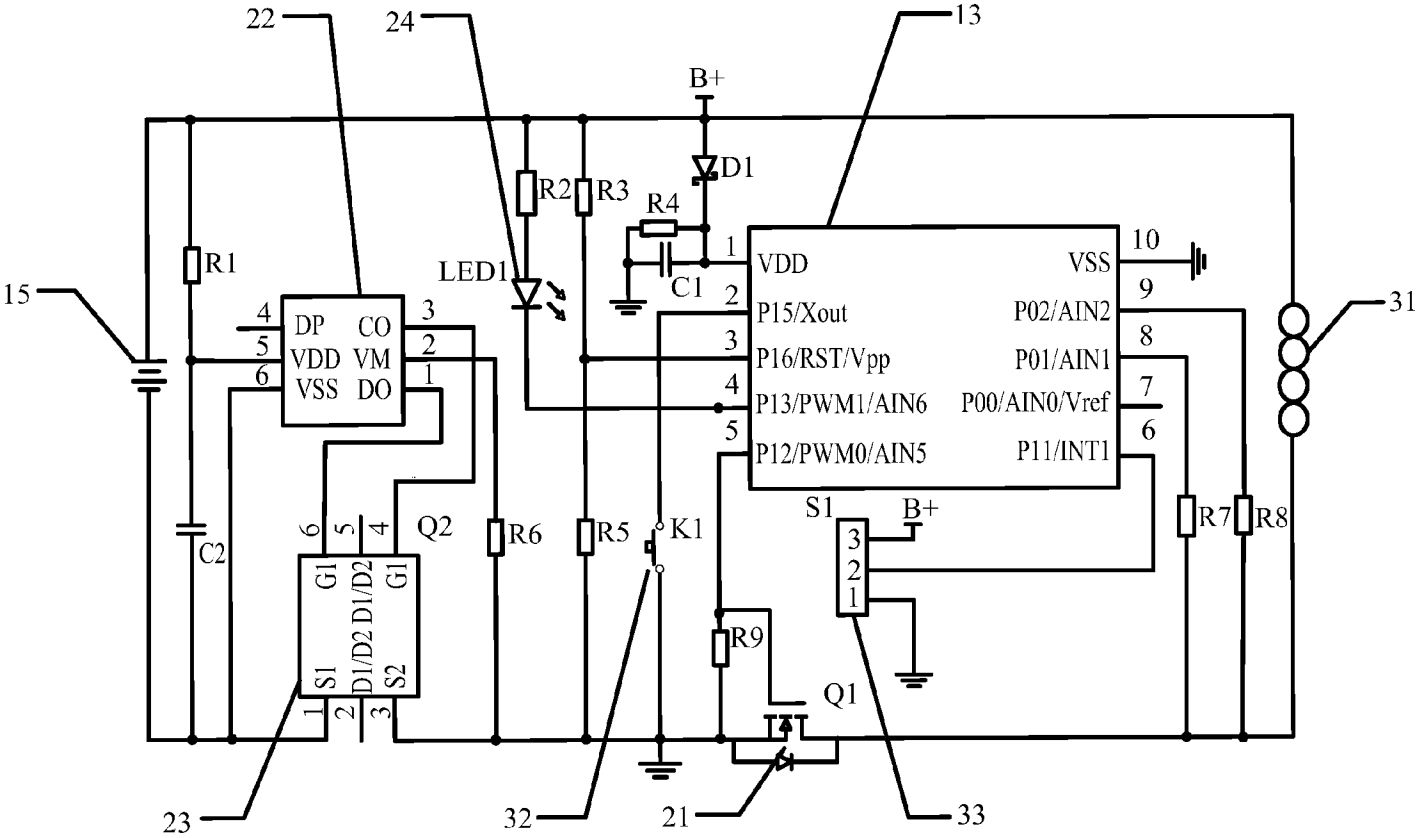
FIG. 2 is a circuit diagram of an electronic cigarette provided according to an embodiment of the disclosure.

The first embodiment will be described with reference to FIG. 2. According to the embodiment, the atomizer assembly 14 is provided with a heat-generating assemble, which may be an electric heating wire, an infrared heating device or an ultrasonic heating device, and is not limited herein. According to the embodiment, an electric heating wire 31 is used as the heat-generating assemble.

The electronic cigarette body also includes a switch 21, which is electrically connected to the microcontroller 13 and the electric heating wire 31 respectively. The switch may be turned on under the control of the microcontroller 13, so that the battery assembly 15 powers the electric heating wire 31 to atomize nicotine liquid to generate smoke.

According to the embodiment, the button module 11 is a button switch 32, and the airflow sensing module 12 is an airflow sensor 33 for sensing pressure change inside the electronic cigarette body. An N-channel field effect transistor or a triode, etc, may be used as the switch 21, and according to the embodiment, the N-channel field effect transistor is used as the switch 21.

According to the embodiment, the electronic cigarette body also includes a display device 24. The display device 24 is electrically connected to the microcontroller 13, and is configured to display operation state of the electronic cigarette. The display device 24 may include a LED. Alternatively the display device 24 may include a LED screen.

According to the embodiment, the user presses the button switch 32 to preheat the electric heating wire 31 of the electronic cigarette for heating nicotine liquid. When the user puffs on the electronic cigarette, the airflow sensor 33 senses pressure change inside the electronic cigarette body to make the electric heating wire 31 atomize nicotine liquid to generate smoke. At this time, the display device 24 displays an operation state of the electronic cigarette. For example, the LED turning red represents that the electronic cigarette is in an operation state.

Alternatively, according to the embodiment, the user may directly puffs on the electronic cigarette, and the airflow sensor 33 senses pressure change inside the electronic cigarette body to make the electric heating wire 31 atomize the nicotine liquid to generate smoke. At this time, the display device 24 displays an operation state of the electronic cigarette. For example, the LED turning red represents that the electronic cigarette is in an operation state. Specific smoking way is not limited herein.

According to the embodiment, the electronic cigarette body further includes a battery protective module. The battery protective module is provided with a charge protective unit 22 and a power protective unit 23. The charge protective unit 22 is configured to detect charging voltage and charging current of the battery assemble 15, and break the charging circuit in a case that the charging voltage is excessive or/and the charging current is excessive. The power protective unit 23 is configured to break the power circuit off if the voltage in the circuit is excessive and/or the current in the circuit is excessive when the battery assemble 15 powers the elements of the electronic cigarette body.

Figure 4:
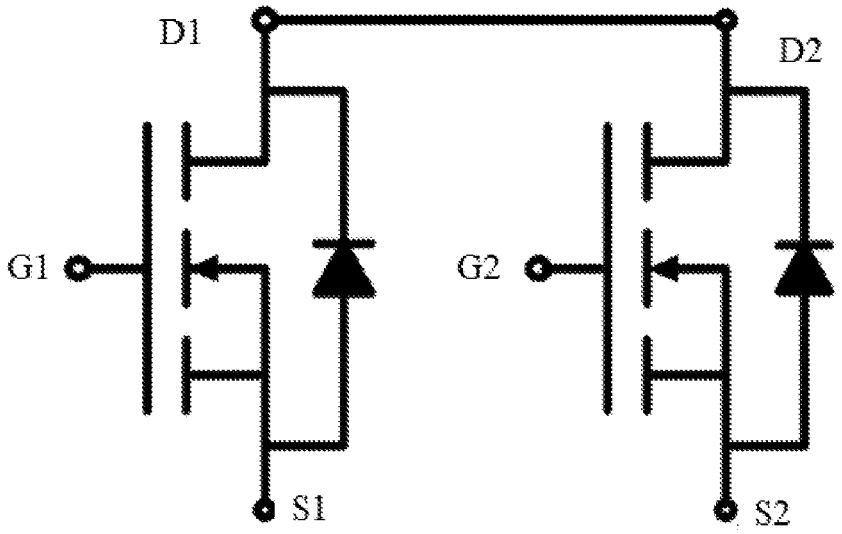
FIG. 4 is an equivalent circuit diagram of two field effect transistors of an electronic cigarette provided according to the disclosure.

The power protective unit 23 includes two field effect transistor, and referring to FIG. 4, the drains of the two field effect tubes are electrically connected to each other.

The charge protective unit 22 may be a S8241 circuit for controlling charge and discharge through monitoring voltage of a battery connected to a node between VDD and VSS and voltage difference between VM and VSS. The power protective unit 23 may be a DT8205 circuit, which equivalents to two field effect transistors.

Embodiment 2 will be described below.

Embodiment 2 differs from embodiment 1 in that the microcontroller 13 is provided with a counting unit. When a user presses the button module 11, the button module 11 may transmit pulse signals to the microcontroller 13, or when the user smokes, the airflow sensing module 12 may transmit pulse signals to the microcontroller 13. The microcontroller 13 may count puff number of the user according to number of times for receiving the pulse signals, which is beneficial for the user to be aware of smoking status of the user.

According to the embodiment, the electronic cigarette body is provided with a display device electrically connected to the microcontroller. The display device may be configured to display the puff number of the user. Through total puff number, the user may get to know how many times left for the user to puff on the electronic cigarette which is limited by the electric energy stored in the battery assembly, thereby preventing shortage of battery power which causes that the user may not smoke.

According to the embodiment, the timing module 16 may protect circuits of the electronic cigarette body and prevent overburning of the atomizer assembly 14. After the user presses the button module 11, if the user does not smoke for a long time, the atomizer assembly 14 is in a heating state all the time. When the atomizer assembly 14 burns up nicotine liquid, dry burning is caused, which is apt to burn the atomizer assembly 14 out, and is apt to cause short circuit to burn out elements of the circuit. This situation can be prevented by the use of the timing module 16. In a case that the user does not smoke for a period of time since the user presses the button module 11, the microcontroller 13 may stop the atomizer assembly 14 according to the interval recorded by the timing module, thereby preventing overburning and short circuit.

The interval recorded by the timing unit may use the factory setting, and is not limited herein.

Embodiment 3 will be described below.

Embodiment 3 differs from the first embodiment and the second embodiment in that the electronic cigarette body includes a boost module. The boost module is electrically connected to the microcontroller 13, the battery assembly 15 and the atomizer assembly 14 respectively, to raise voltage supplied from the battery assembly 15 to the atomizer assembly 14, so that the atomizer assembly 14 may quickly heat nicotine liquid to generate smoke.

It is can be understood that through raising the atomization voltage of the atomizer assembly 14 and power for heating nicotine liquid, the atomizer assembly 14 may quickly heat the nicotine liquid to generate smoke and may generate a lot of smoke, thereby improving user feeling for smoking.

According to the embodiment, the boost module may be a transformer or an amplifier circuit, etc, and is not limited herein.

Figure 3:
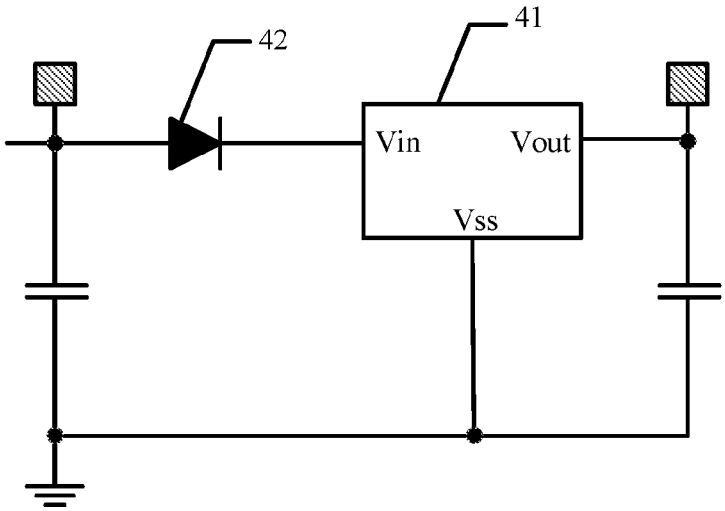
FIG. 3 is a voltage stabilizer circuit diagram of an electronic cigarette provided according to an embodiment of the disclosure.

According to the embodiment, referring to FIG. 3, the electronic cigarette body further includes a voltage stabilizing module.

The voltage stabilizing module is electrically connected to the microcontroller 13 and the battery assembly 15 respectively, to enable the battery assembly 15 to supply stable voltage for the microcontroller 13. The voltage stabilizing module is provided with a diode 42 and a voltage regulator 41. The diode 42 is connected to the voltage regulator 41 in series. The anode of the diode 42 is electrically connected to the power port of the battery assembly 15. The cathode of the diode 42 is electrically connected to the input port of the voltage regulator 41. The diode 42 is configured to prevent reverse conduction of current.

It is may be understood that since the diode has the function of forward conduction and reverse blocking, the diode may prevent reverse conduction of current. The voltage regulator 41 in the stabilizing circuit has the function of voltage stabilization. The voltage regulator may be a TLV70430 voltage regulator, and the type is not limited herein.

According to the disclosure, the microcontroller 13 may be a STM32F030F6 microcontroller, and the type is not limited herein.

Figure 5:
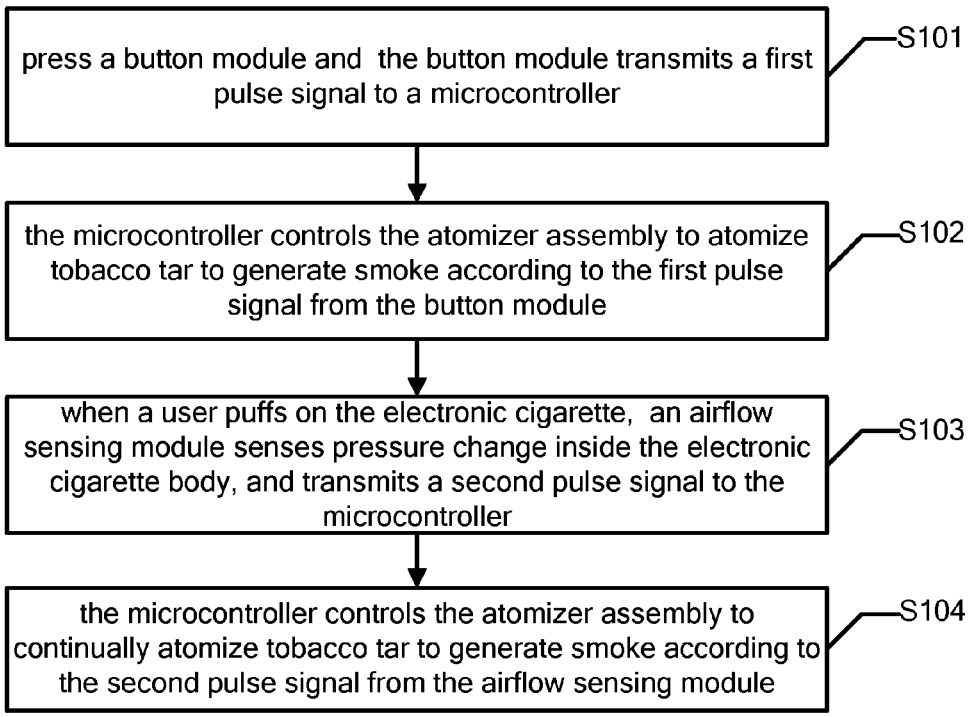
FIG. 5 is an overall flow chart of a method for atomizing provided according to the disclosure.

According to the disclosure, an atomizing method of an electronic cigarette is further provided. Referring to FIG. 5, the method includes following steps:

S101: a button module is pressed, and the button module transmits a first pulse signal to a microcontroller;

S102: the microcontroller controls the atomizer assembly to atomize tobacco tar to generate smoke according to the first pulse signal from the button module;

S103: an airflow sensing module senses pressure change inside the electronic cigarette body and transmits a second pulse signal to the microcontroller when a user puffs on the electronic cigarette; and

S104: the microcontroller controls the atomizer assembly to continually atomize tobacco tar to generate smoke according to the second pulse signal from the airflow sensing module.

In view of this, the button module and the airflow sensing module are integrated into an electronic cigarette, a user may directly smoke, and the airflow sensing module triggers the atomizer assembly to atomize nicotine liquid to generate smoke. Alternatively, if the user wants to smoke, the user may press the button module which triggers the atomizer assembly to atomize nicotine liquid to generate smoke, thereby bringing use convenience to the user. For example, the user may directly smoke without pressing the button module when driving, and the user may smoke by pressing the button module in other situations. Because of the combination of the button module and the airflow sensing module, if the user wants to smoke, the user may press the button module so that the atomizer assembly enters into a heating state. Thus the electronic cigarette may generate a lot of smoke when the user smokes, which may improve user feeling for puffing on the electronic cigarette. The user presses the button module, the atomizer assembly warms up, and then the user starts to smoke. Thus the user does not need suction as much as puffing on a conventional electronic cigarette only with only an airflow sensing module. Therefore the user does not need too much suction quantity. When the button module is pressed, the atomizer assembly starts warming up to atomize nicotine liquid to generate smoke. Thus when the user smokes, through only slight suction, the atomizer assembly may generate a lot of smoke, thereby bringing good smoking effect, and bringing good smoking experience to the user.

Figure 6:
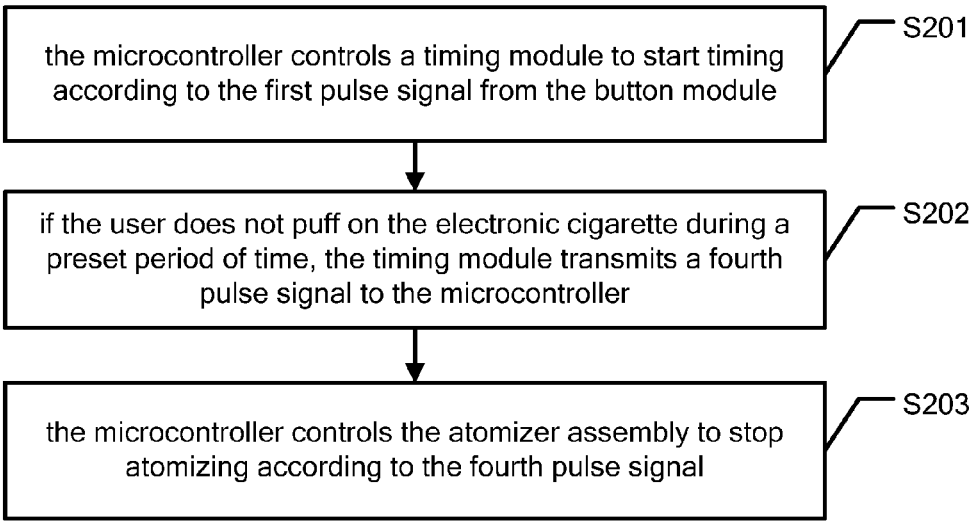
FIG. 6 is a flow chart of a method for atomizing according to an embodiment of the disclosure.

According to the atomizing method of an electronic cigarette, after the microcontroller controls the atomizer assembly to atomize tobacco tar to generate smoke according to a first pulse signal from the button module, the method further includes following steps as shown in FIG. 6:

S201: the microcontroller controls a timing module to start timing according to the first pulse signal from the button module;

S202: the timing module transmits a fourth pulse signal to the microcontroller if the user does not puff on the electronic cigarette during a preset period of time; and S203: the microcontroller controls the atomizer assembly to stop atomizing according to the fourth pulse signal.

The electronic cigarette body includes a timing module. If the user does not puffs on the electronic cigarette during a preset period of time, the microcontroller controls the atomizer assembly to stop preheating according to the pulse signal transmitted by the timing module to prevent overburning of the atomizer assembly, thereby effectively preventing damage of the electronic cigarette.

Figure 7:
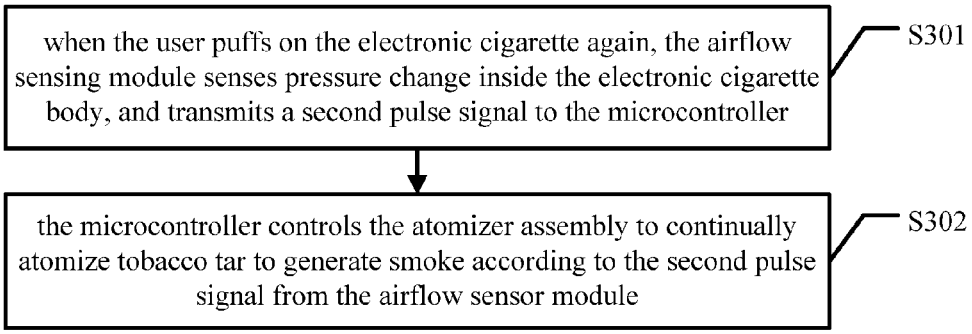
FIG. 7 is a flow chart of a method for atomizing according to another embodiment of the disclosure.

Referring to FIG. 7, the atomizing method of an electronic cigarette further includes the following steps:

S301: the airflow sensing module senses pressure change inside the electronic cigarette body and transmits a second pulse signal to the microcontroller when the user puffs on the electronic cigarette again; and S302: the microcontroller controls the atomizer assembly to continually atomize tobacco tar to generate smoke according to the second pulse signal from the airflow sensor module.

It is may be understood that if the user has pressed the button module, there is no need for the user to press the button module again each time the user puffs on the electronic cigarette because the airflow sensing module may sense pressure change inside the electronic cigarette body and transmit a signal to the microcontroller. The microcontroller controls the atomizer assembly to continually atomize tobacco tar to generate smoke according to the signal from the airflow sensing module.

Figure 8:
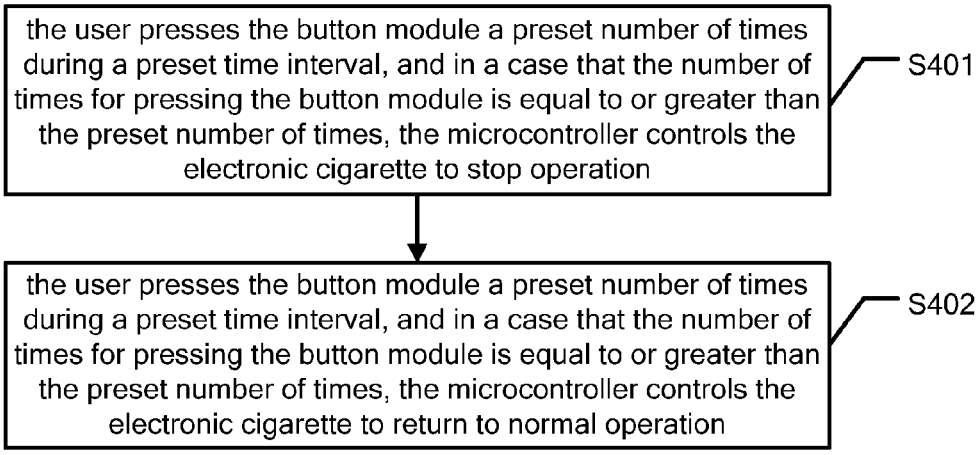
FIG. 8 is a flow chart of a method for atomizing according to another embodiment of the disclosure.

Referring to FIG. 8, the atomizing method of an electronic cigarette further includes following steps:

S401: the user presses the button module a preset number of times during a preset time interval, and in a case that the number of times for pressing the button module is equal to or greater than the preset number of times, the microcontroller controls the electronic cigarette to stop operation; and S402: the user presses the button module a preset number of times during a preset time interval, and in a case that the number of times for pressing the button module is equal to or greater than the preset number of times, the microcontroller controls the electronic cigarette to return to normal operation.

Figure 9:
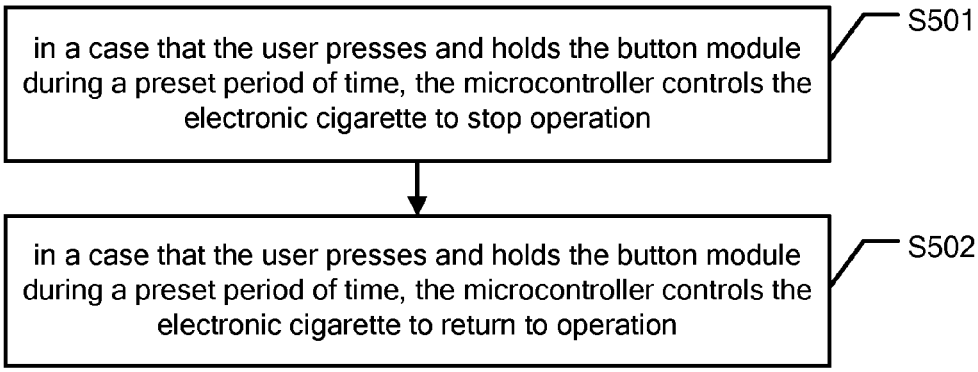
FIG. 9 is a flow chart of a method for atomizing according to another embodiment of the disclosure.

Referring to FIG. 9, the atomizing method of an electronic cigarette further includes following steps:

S501: the microcontroller controls the electronic cigarette to stop operation, in a case that the user presses and holds the button module during a preset period of time; and S502: the microcontroller controls the electronic cigarette to return to operation, in a case that the user presses and holds the button module during a preset period of time.

In this case, the electronic cigarette may be controlled by pressing the button module. When the user does not smoke, the electronic cigarette may be shut down to prevent malfunction of the electronic cigarette. It can also avoid that the button module is accidentally touched by the user who is carrying the button module, which may cause operation of the electronic cigarette and damage of the electronic cigarette.

The embodiments of the present disclosure are described in a progressive manner and each embodiment places emphasis on the difference from other embodiments, therefore, one embodiment can refer to other embodiments for the same or similar parts.

According to the description of the disclosed embodiments, the disclosure may be implemented or used by the person skilled in the art. Various modifications made to these embodiments are apparent for persons skilled in the art, and a normal principle defined in the disclosure may be implemented in other embodiments without departing from spirit or scope of the disclosure. Therefore the disclosure is not limited to the embodiments described in the disclosure but confirms to a widest scope in accordance with principles and novel features disclosed in the disclosure.

What is claimed is:

1. An electronic cigarette, comprising:

an electronic cigarette body, comprising an airflow sensing module, an atomizer assembly, a button module, a battery assembly, a timing module and a microcontroller, wherein:

the microcontroller is configured to receive pulse signals from the airflow sensing module, the button module and the timing module and transmit a control signal to elements of the electronic cigarette body according to the pulse signals from the airflow sensing module, the button module and the timing module;

the airflow sensing module is electrically connected to the microcontroller, and is configured to detect pressure change inside the electronic cigarette body and transmit the pulse signal to the microcontroller;

the button module is electrically connected to the microcontroller, and is configured to transmit the pulse signal to the microcontroller according to pressing operation of a user to make the atomizer assembly performing preheating, causing more smoke volume to be generated when the user puffs the electronic cigarette;

in a case that the user presses the button module a preset number of times during a preset time interval or the user presses and holds the button module during a period of time, the button module transmits the pulse signal to the microcontroller, and the microcontroller makes the electronic cigarette stop operation according to the pulse signal;

in a case that the user presses the button module a preset number of times during a preset time interval or the user presses and holds the button module during a period of time, the button module transmits the pulse signal to the microcontroller, and the microcontroller makes the electronic cigarette return to normal operation according to the pulse signal;

the atomizer assembly is electrically connected to the microcontroller, and is configured to receive the control signal from the microcontroller to atomize nicotine liquid to generate smoke;

the timing module is electrically connected to the microcontroller, and is configured to start timing and make the atomizer assembly perform preheating under control of the microcontroller when the user presses the button module, and if the user does not puff on the electronic cigarette during a preset period of time, the timing module transmit the pulse signal to the microcontroller, and the microcontroller controls the atomizer assembly to stop preheating according to the pulse signal from the timing module to prevent overturning of the atomizer assembly; and the battery assembly is configured to supply electric energy to the microcontroller, the airflow sensing module, the atomizer assembly and other elements of the electronic cigarette.

2. The electronic cigarette according to claim 1, wherein the airflow sensing module comprises an airflow sensor or an integrated microphone switch.

3. The electronic cigarette according to claim 1, wherein:

the atomizer assembly comprises a heat-generating assemble;

the electronic cigarette body further comprises a switch; and the switch is electrically connected to the microcontroller and the heat-generating assemble respectively, and the microcontroller controls to turn on the switch, causing the battery assembly to power the heat-generating assemble to atomize nicotine liquid to generate smoke.

4. The electronic cigarette according to claim 3, wherein:

the electronic cigarette body further comprises a battery protective module;

the battery protective module comprises a charge protective unit and a power protective unit;

the charge protective unit is configured to detect charging voltage and charging current of the battery assembly, and break the charging circuit off in a case that the charging voltage and/or charge current is excessive; and the power protective unit is configured to break a power circuit off in a case that voltage and/or current in the power circuit is excessive, when the battery assemble powers the elements of the electronic cigarette body.

5. The electronic cigarette according to claim 4, wherein the power protective unit comprises two field effect transistor with drains electrically connected to each other.

6. The electronic cigarette according to claim 1, wherein:

the electronic cigarette body further comprises a display device; and the display device is electrically connected to the microcontroller, and is configured to display operational state of the electronic cigarette.

7. The electronic cigarette according to claim 1, wherein:

the electronic cigarette body further comprises a boost module; and the boost module is electrically connected to the microcontroller, the battery assembly and the atomizer assembly respectively, and is configured to raise voltage supplied from the battery assembly to the atomizer assembly, causing the atomizer assembly to quickly heat nicotine liquid to generate smoke.

8. The electronic cigarette according to claim 1, wherein:

the electronic cigarette body further comprises a voltage stabilizing module; and the voltage stabilizing module is electrically connected to the microcontroller and the battery assembly respectively, and is configured to enable the battery assembly to supply stable voltage for the microcontroller.

9. The electronic cigarette according to claim 8, wherein:

the voltage stabilizing module comprises a diode and a voltage regulator;

the diode is connected to the voltage regulator in series;

the anode of the diode is electrically connected to a power port of the battery assemble;

the cathode of the diode is electrically connected to an input port of the voltage regulator; and the diode is configured to prevent reverse conduction of current.

10. An atomizing method of an electronic cigarette, comprising:

pressing a button module, and transmitting, by the button module, a first pulse signal to a microcontroller;

controlling, by the microcontroller, an atomizer assembly to atomize tobacco tar to generate smoke according to the first pulse signal from the button module;

sensing, by an airflow sensing module, pressure change inside the electronic cigarette body and transmitting a second pulse signal to the microcontroller, when a user puffs on the electronic cigarette;

controlling, by the microcontroller, the atomizer assembly to continually atomize tobacco tar to generate smoke according to the second pulse signal from the airflow sensing module;

in a case that the user presses the button module for times equal to or greater than a preset number of times during a preset time interval or the user presses and holds the button module during a preset period of time, controlling, by the microcontroller, the electronic cigarette to stop operation; and in a case that the user presses the button module for times equal to or greater than a preset number of times during a preset time interval or the user presses and holds the button module during a preset period of time, controlling, by the microcontroller, the electronic cigarette to return to normal operation, wherein after the microcontroller controls the atomizer assembly to atomize tobacco tar to generate smoke according to the first pulse signal from the button module, the method further comprises:

controlling, by the microcontroller, a timing module to start timing according to the first pulse signal from the button module;

in a case that the user does not puff on the electronic cigarette during a preset period of time, transmitting, by the timing module, a fourth pulse signal to the microcontroller; and controlling, by the microcontroller, the atomizer assembly to stop atomization according to the fourth pulse signal.

11. The atomizing method of the electronic cigarette according to claim 10, further comprising:

sensing, by the airflow sensing module, pressure change inside the electronic cigarette body and transmitting a second pulse signal to the microcontroller, when the user puffs on the electronic cigarette again; and controlling, by the microcontroller, the atomizer assembly to continually atomize tobacco tar to generate smoke according to the second pulse signal from the airflow sensing module.

* * * * *